US007683542B2

(12) United States Patent
Voronov et al.

(10) Patent No.: US 7,683,542 B2
(45) Date of Patent: Mar. 23, 2010

(54) DIRECT COOLING OF AN AMALGAM DEPOSIT IN A LOW-PRESSURE MERCURY AMALGAM LAMP

(75) Inventors: Alexei Voronov, Hanau (DE); Erich Arnold, Mainz (DE); Erik Roth, Altenstadt (DE)

(73) Assignee: Heraeus Noblelight GmbH, Hanau (DE)

( * ) Notice: Subject to any disclaimer, the term of this patent is extended or adjusted under 35 U.S.C. 154(b) by 832 days.

(21) Appl. No.: 11/419,303

(22) Filed: May 19, 2006

(65) Prior Publication Data

US 2006/0261735 A1 Nov. 23, 2006

(30) Foreign Application Priority Data

May 20, 2005 (DE) ..... 10 2005 023 940

(51) Int. Cl.
*H01J 17/00* (2006.01)
*H01J 17/26* (2006.01)
*H01J 17/16* (2006.01)

(52) U.S. Cl. ..... 313/565; 313/490; 313/545; 313/564; 313/567; 313/634

(58) Field of Classification Search ..... None
See application file for complete search history.

(56) References Cited

U.S. PATENT DOCUMENTS

| | | | | |
|---|---|---|---|---|
| 5,095,336 | A | 3/1992 | Corona et al. | |
| 5,245,246 | A | 9/1993 | Boland et al. | |
| 5,754,000 | A * | 5/1998 | Skilton et al. | 313/565 |
| 6,906,460 | B2 * | 6/2005 | Busai et al. | 313/565 |
| 7,049,738 | B2 * | 5/2006 | Fischer et al. | 313/490 |
| 7,061,173 | B2 * | 6/2006 | Fischer et al. | 313/490 |
| 2004/0232846 | A1 * | 11/2004 | Fischer et al. | 315/94 |

FOREIGN PATENT DOCUMENTS

| | | |
|---|---|---|
| DE | 1 160 947 | 7/1964 |
| DE | 102 01 167 A1 | 8/2003 |
| DE | 103 25 514 A1 | 1/2004 |
| WO | 9631902 A1 | 10/1996 |

* cited by examiner

*Primary Examiner*—Nimeshkumar D Patel
*Assistant Examiner*—Natalie K Walford
(74) *Attorney, Agent, or Firm*—Panitch Schwarze Belisario & Nadel LLP

(57) ABSTRACT

An arrangement of a low-pressure mercury amalgam lamp includes an amalgam deposit and a cladding tube surrounding a lamp, wherein the lamp has a mechanical contact to the cladding tube in a region of the amalgam deposit. A ring-shaped band contacting and surrounding the lamp in the region of the amalgam deposit represents the mechanical contact to the cladding tube.

4 Claims, 2 Drawing Sheets

DIRECT COOLING OF AN AMALGAM DEPOSIT IN A LOW-PRESSURE MERCURY AMALGAM LAMP

BACKGROUND OF THE INVENTION

The invention relates to a high-power low-pressure mercury amalgam lamp with an amalgam deposit and a cladding tube surrounding the lamp. The invention also relates to a manufacturing method for an arrangement of the lamp in the cladding tube.

For such lamps, as disclosed, for example, in German published patent application DE 102 01 617 A1 and International Application Publication No. WO 96/31902, the lamp and the cladding tube are separated from each other by a radial air gap in the discharge region and particularly in the region of the amalgam deposit.

According to WO 96/31902, bulges of the lamp tube can be brought into contact with an external cladding tube.

According to DE 102 01 617 A1, a heating element can be mounted between the lamp and cladding tube, so that it is also usable for cooling the amalgam deposit.

BRIEF SUMMARY OF THE INVENTION

An object of the present invention is to operate such high-power lamps with a power density of over 3 W/cm, particularly a power density of over 5 W/cm, and to fashion arrangements for this purpose as simply as possible.

To achieve this object, a heat conductive film is applied in the region of the amalgam deposit, or the lamp is surrounded by a band in the region of the amalgam deposit.

A device according to one embodiment of the invention includes an arrangement of a low-pressure mercury amalgam lamp having an amalgam deposit and a cladding tube surrounding a lamp, wherein the lamp has a mechanical contact to the cladding tube in the region of the amalgam deposit, and according to the invention, the lamp is surrounded in the region of the amalgam deposit by a ring-shaped band lying against the lamp, and the band represents the mechanical contact to the cladding tube. Bands made of metal or plastic, particularly fluoropolymers, have proven advantageous.

Instead of the band, a film, particularly made of metal or plastic and arranged in the region of the amalgam deposit between the lamp and cladding tube, is also suitable for heat transfer.

A device according to another embodiment of the invention includes an arrangement of a low-pressure mercury amalgam lamp having an amalgam deposit and a cladding tube surrounding an lamp, wherein the lamp has a mechanical contact to the cladding tube in the region of the amalgam deposit, and according to the invention, the lamp has a film in the region of the amalgam deposit for heat transfer from the lamp to the cladding tube, wherein the heat transfer coefficient of the film corresponds at least to that of the cladding tube.

A method according to the invention includes a method for manufacturing an arrangement of high-power, low-pressure mercury amalgam lamps having an amalgam deposit and a cladding tube surrounding a lamp, wherein a mechanical contact between the lamp and the cladding tube is produced in the region of the amalgam deposit and is used for cooling the amalgam deposit and, according to the invention, a ring-shaped band is applied around the lamp in the region of the amalgam deposit.

In preferred embodiments:

a band is tensioned around the lamp;

the band is a metal or plastic band;

the plastic band contains fluoropolymer;

the fluoropolymer is polytetrafluoroethylene (PTFE);

the band is formed as a clamp;

the clamp is a metal clamp;

the clamp comprises an elastomer, particularly a fluoroelastomer;

a band made of metal or PTFE surrounds lamps with a power density of over 3 W/cm, particularly over 5 W/cm, in the region of the amalgam deposit;

the thickness of the band or the film for heat transfer exceeds the tolerances of the lamp and the cladding tube, so that the lamp contacts the cladding tube only via the bands or the film for heat transfer;

the film is a film made of a fluoropolymer;

the fluoropolymer is a thermoplastic;

the thermoplastic has ether groups (PFA); and the thermoplastic fluoropolymer has side groups (FEP).

The lamp can lie loosely or tightly against the band or the film for heat transfer in the cladding tube. For upright lamps, an attachment of the lamp in the cladding tube is advantageous, in order to guarantee contact.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1A:
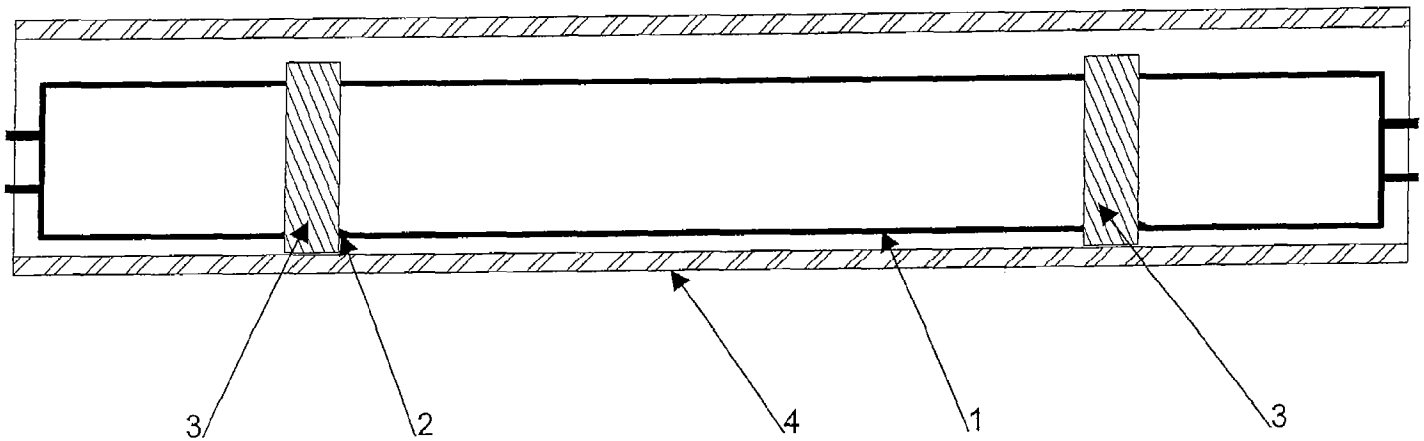
FIG. 1A is a schematic, longitudinal side view, partially in section, of a lamp having a lamp with non-tensioned bands in the region of the amalgam deposit, according to one embodiment of the invention.
Figure 1B:
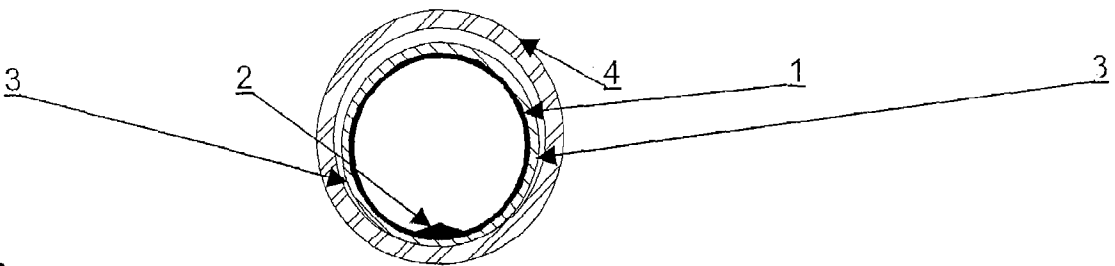
FIG. 1B is a cross-sectional view through one of the bands of FIG. 1A.

In one embodiment according to FIGS. 1A and 1B, a metal band 3 is tensioned around a lamp 1 in the region of the amalgam deposit 2, with the metal band 3 forming a mechanical contact to the cladding tube 4 after the band is inserted into the cladding tube 4. The metal band 3 can be fixed around the lamp tube in the form of a screw clip. For mass production, tightening of a metal band 3, analogous to packing technology, has proved itself. For this purpose, the metal band 3 is tightened with a tensioning device, placed one above another, and the sections lying one above the other are fastened to each other. Fastening the ends lying one above the other with a collar has proven advantageous.

Based on this technology, lamps 1 having a power of 500 watts and 800 watts or a power density of 3 W/cm and 5 W/cm are operated in an externally water-cooled cladding tube 4. For this purpose, the lamps 1 are pushed into the cladding tube 4, on which they eventually contact the metal band 3.

Particularly suitable is a cladding tube 4 made of quartz glass. For the lamp 1 with a power density of 3 W/cm, an optimum operating temperature of the amalgam deposit 2 is set with a 5 mm wide and 0.5 mm thick metal band 3 made of stainless steel. For the lamp 1 with a power density of 5 W/cm, the band width is doubled. Incidentally, the lamp corresponds to any low-pressure mercury amalgam lamp having an amalgam deposit 2, as may be taken, for example, from the prior art cited above.

Alternatively, the band is formed as a clamp, which clamps around the lamp.

In another embodiment according to FIGS. 1A and 1B, instead of the metal band of the configuration above, a 1.5 mm wide band made of polytetrafluoroethylene (PTFE) is used. For the lamp with a power density of 3 W/cm, the thickness of the PTFE band is 0.7 mm, and for the lamp with a power density of 5 W/cm, the thickness of the PTFE band is 1 mm.

As another embodiment, a fluoroelastomer is formed as a clamp, which clamps around the lamp.

Figure 2A:
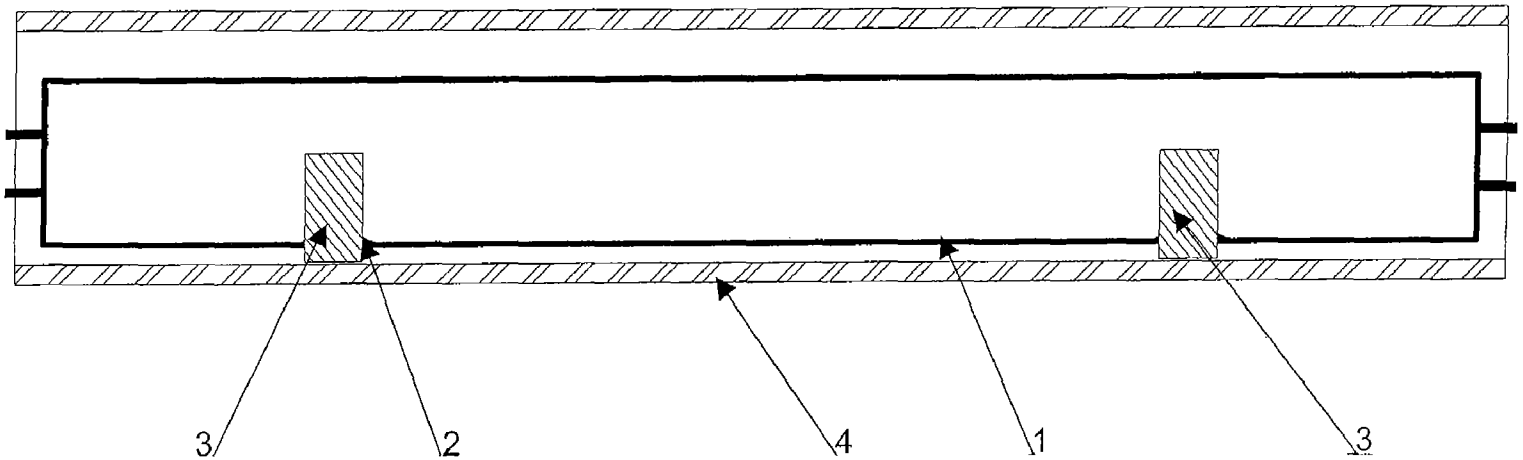
FIG. 2A is a schematic, longitudinal side view, partially in section, of a lamp showing a heat bridge between the lamp and cladding tube, according to another embodiment of the invention.
Figure 2B:
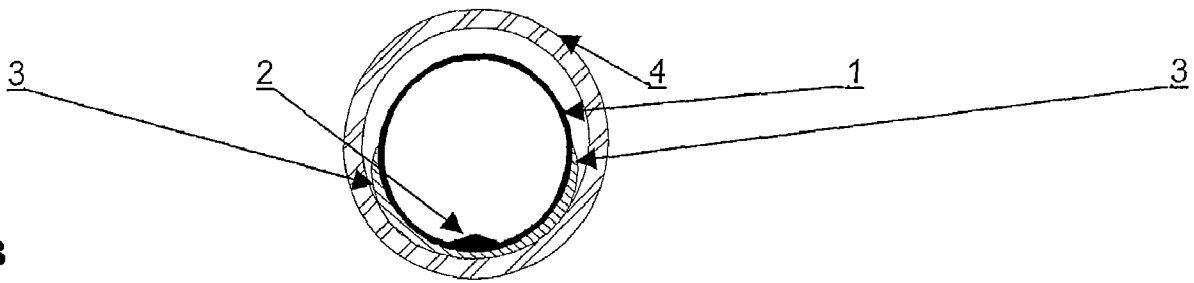
FIG. 2B is a cross-sectional view through one of the heat bridges of FIG. 2A

In an embodiment according to FIGS. 2A and 2B, a heat transfer film 3, with which the lamp lies on the cladding tube 4, is arranged on the lamp 1 in the region of the amalgam deposit 2. The film 3 can be applied with a paste according to thick-film technology.

In another embodiment according to FIGS. 2A and 2B, a film 3 is arranged between the lamp and cladding tube. For this purpose, the film 3 is applied according to paste technology and thereafter sintered.

In a further embodiment according to FIGS. 2A and 2B, a thermoplastic film made of fluoropolymer, particularly PFA or FEP, is applied as a molten material on the lamp or in the cladding tube or between the lamp and cladding tube.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An arrangement of a low-pressure mercury amalgam lamp, comprising an amalgam deposit (2) and a cladding tube (4) surrounding a lamp (1), wherein the lamp (1) has a mechanical contact to the cladding tube (4) in a region of the amalgam deposit (2), and wherein the mechanical contact to the cladding tube comprises a tight-fitting ring-shaped band (3) contacting and surrounding the lamp (1) in the region of the amalgam deposit (2).

2. The arrangement according to claim 1, wherein the band (3) comprises a metal band.

3. The arrangement according to claim 1, wherein the band (3) comprises a plastic band.

4. A method for manufacturing an arrangement of high-power, low-pressure mercury amalgam lamps having an amalgam deposit (2) and a cladding tube (4) surrounding a lamp (1), the method comprising producing a mechanical contact between the lamp (1) and the cladding tube (4) in a region of the amalgam deposit (2), the mechanical contact being used for cooling the amalgam deposit (2), wherein producing the mechanical contact comprises placing a tight-fitting ring-shaped band (3) around the lamp (1) in the region of the amalgam deposit (2).

* * * * *